US005265796A

United States Patent [19]

Gulliver et al.

[11] Patent Number: 5,265,796

[45] Date of Patent: Nov. 30, 1993

[54] PLURAL COMPARTMENT CARTON FOOD TRAY WITH IMPROVED CORNER CONSTRUCTION

[75] Inventors: Richard F. Gulliver; James R. Green, both of Tuscaloosa, Ala.

[73] Assignee: Gulf States Paper Corporation, Tuscaloosa, Ala.

[21] Appl. No.: 975,005

[22] Filed: Nov. 12, 1992

Related U.S. Application Data

[63] Continuation-in-part of Ser. No. 796,599, Nov. 13, 1991, Pat. No. 5,183,201.

[51] Int. Cl.[5] ..... B65D 5/48

[52] U.S. Cl. ..... 229/120.16; 229/186; 229/228; 229/242; 229/906

[58] Field of Search ..... 229/120.16, 120.17, 229/125.35, 186, 228, 240, 242–244, 902, 903, 906

[56] References Cited

U.S. PATENT DOCUMENTS

| | | | |
|---|---|---|---|
| 2,781,159 | 2/1957 | Copeman | 229/186 |
| 3,146,934 | 9/1964 | Steiger | 229/186 |
| 3,211,359 | 10/1965 | Fickes | 229/240 |
| 3,721,380 | 3/1973 | Meyers | 229/120.17 |
| 3,829,004 | 8/1974 | Graser . | |
| 4,130,237 | 12/1978 | Struble | 229/40 |
| 4,215,780 | 8/1980 | Carlson | 206/424 |
| 4,304,352 | 12/1981 | Humphries | 229/186 |
| 4,361,236 | 11/1982 | Lavery . | |
| 4,594,492 | 6/1986 | Maroszek | 206/591 |
| 4,746,019 | 5/1988 | Prater | 229/232 |
| 4,836,439 | 6/1989 | Hart | 229/104 |
| 4,848,648 | 7/1989 | Eisman | 229/120.17 |
| 4,901,911 | 2/1990 | Drexhage | 229/114 |
| 4,905,889 | 3/1990 | Schuster | 229/120.17 |
| 4,919,785 | 4/1990 | Willey et al. | 229/188 |
| 4,930,639 | 6/1990 | Rigby | 229/186 |
| 4,944,451 | 7/1990 | Forbes, Jr. | 229/120.17 |
| 4,951,868 | 8/1990 | Mode | 229/125.35 |
| 5,009,320 | 4/1991 | Kramer | 229/232 |
| 5,009,363 | 4/1991 | Zavatone | 229/120.16 |
| 5,183,201 | 2/1993 | Gulliver | 229/117.12 |

*Primary Examiner*—Gary E. Elkins

*Attorney, Agent, or Firm*—Cushman, Darby & Cushman

[57] ABSTRACT

A plural compartment carton tray is constructed from a blank. The inner compartments are integrally interconnected and arranged in side-by-side relation to provide the carton blank with an exterior periphery having spaced exterior corners. At least two of the exterior corners having a gusset wall panel integral with adjacent side wall panels along two end fold lines extending in angularly related relation with respect to one another. The side wall panels are folded along the side fold lines in the same direction into an erected position while each of the gusset wall panels is folded along the associated angularly related end fold lines in opposite directions with respect to the associated pair of adjacent side wall panels so as to bring each gusset wall panel into surface-to-surface abutting relation with an end portion of one of the associated pair of adjacent side wall panels defined by one of the associated two end fold lines. An adhesive serves to adhere each gusset wall panel in surface-to-surface abutting relation with the associated one side wall end portion to thereby form a sealed integral corner construction between the adjacent side wall panels.

20 Claims, 3 Drawing Sheets

44
94
54
56
50
64
60
90
84
48
66
58
62
52
52
62
46
58
56
66
60
54
90
84
50
64
94

72
5
74
72
22
26
22
26
42
28
28
24
42
24
32
32
68
40
2
70
66
6
6
66
12
12
76
24
20
16
24
68
32
32
22
28
74
28
22
42
26
42
26
72
5

PLURAL COMPARTMENT CARTON FOOD TRAY WITH IMPROVED CORNER CONSTRUCTION

This application constitutes a continuation-in-part of application Ser. No. 07/796,599, filed Nov. 13, 1991, now U.S. Pat. No. 5,183,201 in name of Richard F. Gulliver for CARTON TRAY WITH IMPROVED CORNER CONSTRUCTION AND METHOD OF MAKING. The disclosure of the '559 application is hereby incorporated by reference into the present specification.

This invention relates to food packages and more particularly to food packages of the type including a carton assembly containing separated plural food portions.

The '599 application identified above discloses a food package which includes a carton assembly containing a single food portion. The carton assembly consists essentially of an open top tray structure within which the food portion is contained and a lid structure secured to the tray structure in enclosing relation to the open top thereof. The tray structure is suitable to retain consumable food contents therein containing liquid so that the contents can be (1) heated in an oven while retained therein and (2) thereafter consumed while retained therein.

The '599 tray is erected from a flat carton blank which includes (1) a bottom wall panel having a periphery defined along four sides by four side fold lines interrelated so that there are four different pairs of adjacent side fold lines wherein each pair of adjacent side fold lines extends at an angle with respect to each other from a corner point defining one of four corners of the bottom wall panel, (2) four side wall panels integral with the bottom wall panel along the four side fold lines interrelated so that there are four pairs of adjacent side wall panels, and (3) a gusset wall panel integral with each pair of adjacent side wall panels along two end fold lines extending in angularly related relation with respect to one another from the corner point associated with the pair of adjacent side fold lines with which the pair of adjacent side wall panels is integral. The side wall panels are folded along the side fold lines in a direction which is the same in relation to the bottom wall panel into an erected position wherein each of the gusset wall panels is folded along the associated angularly related end fold lines in opposite directions with respect to the associated pair of adjacent side wall panels so as to bring each gusset wall panel into surface-to-surface abutting relation with an end portion of one of the associated pair of adjacent side wall panels defined by one of the associated two end fold lines. An adhesive serves to adhere each of the gusset wall panels in abutting relation with the associated one side wall end portion to thereby form a sealed integral corner construction between each pair of adjacent side wall panels which is defined (1) exteriorly by the associated gusset wall panel adhesively adhered in abutting relation to the associated one side wall end portion with the associated one end fold line extending generally in plane coincident with an interior surface of the associated one side wall panel from the associated corner point and (2) interiorly by another of the associated two end fold lines extending from the associated corner point along the surface of the associated one side wall panel.

The corner construction of the '599 application has the advantage that it can be machine set up in a much quicker time than a corner construction utilizing two gusset wall panels which are initially adhered together and then folded and secured in abutting relation to an exterior surface of an adjacent side wall. This quicker set up time is highly advantageous and cost effective because the set up time for the cartons is a limiting factor in packaging lines utilizing trays of this type. It is presently estimated that an operation which heretofore was of a capacity requiring four lines could be handled in the same time with three lines a significant cost reduction for the packager.

The adhesively sealed abutting gusset wall panels and side wall end portions extending exteriorly at each corner construction provide added functional advantages. The adhesively sealed abutting gusset wall panel and side wall end portion extending exteriorly at each corner construction in the most simplistic form of carton tray provide handles enabling a user to conveniently carry the carton tray and its contents to an from the heating oven. The extending corner construction is sufficiently isolated from the food portions so that the trays can be carried by the handles even when the food is very hot.

It is an object of the present invention to provide a carton tray blank capable of being erected into a plural compartment carton tray having a plurality of integrally interconnected inner compartments and at least two exterior corners having the corner construction of the type disclosed in the '599 application.

The carton tray blank of the present invention is cut and scored to comprise a plurality of interconnected integral inner compartment blank sections, the inner compartments corresponding in number to the number of separate portions of food. Each inner compartment blank section is cut and scored to include:

(1) A bottom wall panel having a periphery defined by interconnecting side fold lines wherein each pair of adjacent side fold lines extend at an angle with respect to each other from a corner point defining a corner of the bottom wall panel.

(2) Side wall panels with outer edges and inner edges, the inner edges being integral with the bottom wall panel along the side fold lines. The side wall panels are interrelated so that there are a plurality of pairs of adjacent side wall panels extending from the side fold lines. The side fold lines are foldable along the side fold lines in a direction which is the same relative to the bottom wall panel to form compartment sides.

(3) Gusset wall portions integral with and interconnecting each pair of adjacent side wall panels, the gusset wall portions are foldable and sealable to form leak tight sealed corners.

The compartment blank sections, when erected, are integrally interconnected and arranged in side-by-side fashion to provide the carton tray with an exterior periphery having spaced exterior corners. The integral interconnection between compartment blanks are provided on the side wall panels of adjacent compartments, which are foldably attached to one another along their outer edges to form a partition between adjacent compartments when folded. At least two of the exterior corners each have the gusset wall portion that is associated with the pair of side wall panels thereof comprising a gusset wall panel integral with the associated pair of adjacent side wall panels along two end fold lines extending in angular relation with respect to one another from the corner point associated with the pair of adjacent fold lines with which said pair of adjacent side wall panels is integral. Each of the at least two exterior corners have their respective gusset wall panels being foldable along the associated angularly related end fold lines in opposite directions with respect to the associated pair of adjacent side wall panels so as to bring each gusset wall panel into surface-to-surface abutting relation with an end portion of one of the associated pair of adjacent side wall panels defined by one of the associated two end fold lines. Each of the gusset wall panels associated with the at least two exterior corners are capable of being adhesively adhered in surface-to-surface abutting relation with the associated one side wall end portion to thereby form a sealed integral corner construction between the associated pair of adjacent side wall panels which is defined (1) exteriorly by the associated gusset wall panel adhesively adhered in abutting relation to the associated one side wall end portion with the associated one end fold line extending generally in a plane coincident with an interior surface of the associated one side wall panel from the associated corner point and (2) interiorly by another of the associated two end fold lines extending from the associated corner point generally along the interior surface of the associated one side wall panel.

The above-mentioned tray-forming blanks can be erected by folding and securing the same in a tray-forming condition. Once erected, a plurality of food products may be deposited into the plural compartment of the carton tray. The carton tray can then be sealed with a lid to form a completed food package. Accordingly, another object of the present invention is to provide an carton tray erected from the above described carton tray blank.

It is a further object of the present invention to provide a complete food package comprised of the plural compartment tray of the present invention, therein being plural food portions therein, and a sealed lid part enclosing the food portions.

After the carton tray with the food portions therein has been closed by the carton lid, the package can be handled and transported as a unit. Where the contents are to be frozen, the stability of exterior flange panels at one pair of opposite carton side walls is particularly important in conjunction with the perpendicular planar exterior surfaces presented by the other pair of opposite carton side walls. In most frozen food processing lines, the cartons containing the frozen food must be handled in abutting relation. The carton side walls providing perpendicular planar exterior surfaces clearly permit abutment handling in a stable fashion as well as display stacking with the perpendicularly planar exterior carton side walls disposed in horizontal planes. Similarly, the stabilized exterior flange panels permit stable abutment handling in the frozen food line as well as stable multiple carton packaging for shipment. Once in the hands of the ultimate user, the package can be readily vented and carried to and from a heating oven and thereafter opened for consumption.

The invention may best be understood with reference to the accompanying drawings wherein an illustrative embodiment is shown.

IN THE DRAWINGS

Figure 1:
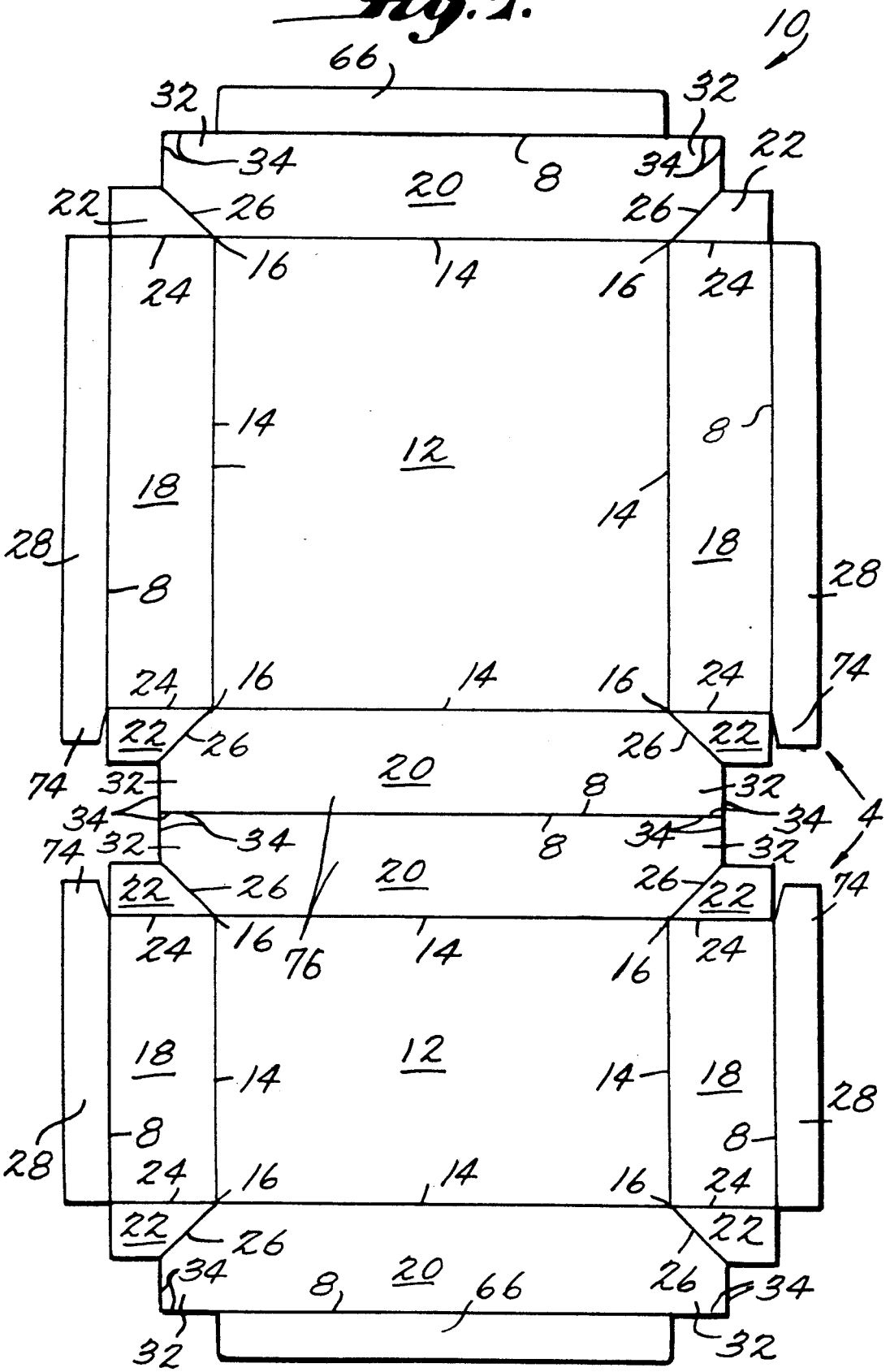
FIG. 1 is a top plan view of one embodiment of a carton tray blank constructed in accordance with the principles of the present invention.

Referring now more particularly to FIG. 1 of the drawings, there is shown therein a carton tray blank, generally indicated at 10, which is erectable to form a plural compartment carton tray embodying the principles of the present invention. The blank 10 is formed of any suitable carton material as, for example, paperboard. It will be understood that the carton material may be in the form of a laminate, such as a plastic film (e.g., polyester, polypropylene or PET) laminated to paperboard. Preferably, the plastic film is on the interior of the paperboard blank although it may be provided on the exterior as well. The laminate may include in selective portions throughout the paperboard material a microwave susceptor material. The susceptor material may either be microwave-interactive or microwave-shielded material.

As shown, the blank material is suitably cut and/or scored to provide a plurality of compartment blank sections 4. Each compartment blank section 4 consists of a bottom wall panel 12 defined peripherally by four side fold lines 14 defining four corners 16. Each compartment blank section 4 also includes first pair of opposite side wall panels 18 and second pair of opposite side wall panels 20. Each of the side wall panels 18 and 20 are integral with the bottom panels 12 along the side fold lines 14. The fold lines 14 may be of any desired construction, an exemplary embodiment being regular bar scores as viewed from the side of the blank forming the interior of the carton tray when erected. The side shown in FIG. 1 is also the side of the carton tray blank 10 on which the plastic film is adhered when the blank is made of a laminate.

Each compartment blank section 4 includes four gusset wall panels 22, each of which is integral with a side wall panel 18 and an adjacent side wall panel 20 along two end fold lines 24 and 26 extending from an associated corner 16 in angularly related relation with respect to one another. As shown, the end fold line 24 of each gusset wall panel 22 is integral with an end of one of the first pair of opposite side wall panels 18 and extends from the associated corner 16 with respect to the associated side fold line 14 at an angle of approximately 90°.

Side wall panels 20 include an outer end portion 32 at each end thereof which is defined by the associated fold line 26 and a peripheral edge 34 intersecting with the associated end of the associated side wall outer edge 8. The end fold lines 24 may, by example, be formed as reverse bar scores which are offset with respect to the corner 16 a distance equal to the paperboard thickness. The other end fold line 26 of each gusset wall panel 22 is integral with an end of one of the second pair of opposite side wall panels 20 and extends from the associated corner 16 at an angle of approximately 135° with respect to the associated side fold line 14. The end fold lines 26 may, by example, be regular bar scores the ends of which are spaced slightly from the ends of the fold lines once folded.

Figure 2:
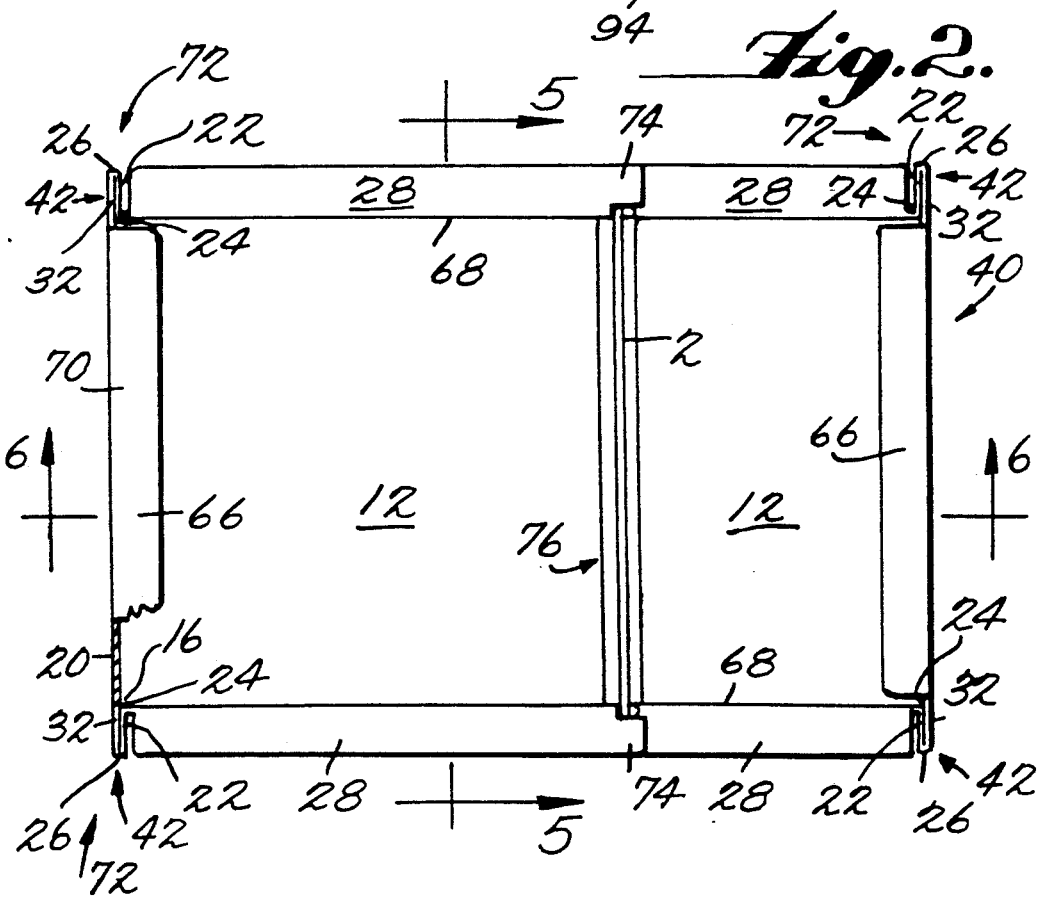
FIG. 2 is a top plan view of an erected carton tray embodying the principles of the present invention.

Each compartment blank section 4 is in side-by-side relation with at least one other compartment blank section. Adjacent compartment blank section are integrally interconnected to one another along outer edges 8 of side wall panels 20 of adjacent compartment sections. The interconnection of the compartment blank sections 4 provides the erected carton tray 40, as shown in FIG. 2, with one exterior periphery defined generally by those side wall panels 18 and 20 comprising first opposing carton side walls, generally indicated at 68, and second opposing carton side walls, generally indicated at 70, forming the peripheral walls of the carton tray 40 when folded. The exterior periphery has spaced exterior corners 72, each exterior corner defined generally at the meeting of one carton side wall 68 with an angularly related carton side wall 70.

First opposing carton side walls 68 include flange panels 28 formed integrally therewith throughout the width thereof along outer edges 8. Second opposing carton side walls 70 include flange panels 66 formed integrally therewith in the central portion thereof along outer edges 8 between the peripheral edges 34. Flange panels 28 each have extending end portions 74 which overlap one another, as shown in FIG. 2, when the carton tray blank is folded into carton tray 40.

To form the plural compartment carton tray, indicated generally at 40 in FIG. 2, from the carton tray blank 10 of the present invention, the side wall panels 18 and 20 are folded about the side fold lines 14 in the same direction. Concurrently with the folding movement of the side wall panels 18 and 20, the gusset wall panels 22 are progressively folded along the angularly related end fold lines 24 and 26 in opposite directions with respect to the associated pair of adjacent side wall panels 18 and 20 so as to bring the gusset wall panels 22 into surface-to-surface abutting relation with the end portions 32 of the side wall panels 20 defined by the end fold lines 26 and peripheral edges 34. The gusset wall panels 22 are then adhesively adhered in surface-to-surface abutting relation with the end portions 32 to thereby form a sealed integral corner construction, generally indicated at 42 in FIG. 2, between each pair of adjacent side wall panels 18 and 20 extending outwardly from the side wall panels 18.

When folded, the foldably attached adjacent side walls 20 of adjacent compartments comprise a partition, generally indicated at 76, between compartments. A constructed plural compartment carton tray 40 is shown in FIGS. 3–6. As shown most clearly in FIG. 6, partition 76 divides separate food contents 80 in separate compartments.

Although the Figures show a carton tray with two food compartments, it is to be understood that the carton tray may just as easily be provided with any number of integrally interconnected compartments of the same construction.

The adhesive utilized may be of any type including either heat activated or pressure activated adhesives. Where the carton material comprises a laminate including a plastic film on the interior surface of the paperboard, portions of the plastic film itself may constitute the adhesive which is activated by heat preferably by directing a stream of hot air locally thereto just prior to the erecting procedure. The adhesive may be separately applied to the appropriate portions of the carton tray blank 10 prior to erection or during erection.

Figure 3:
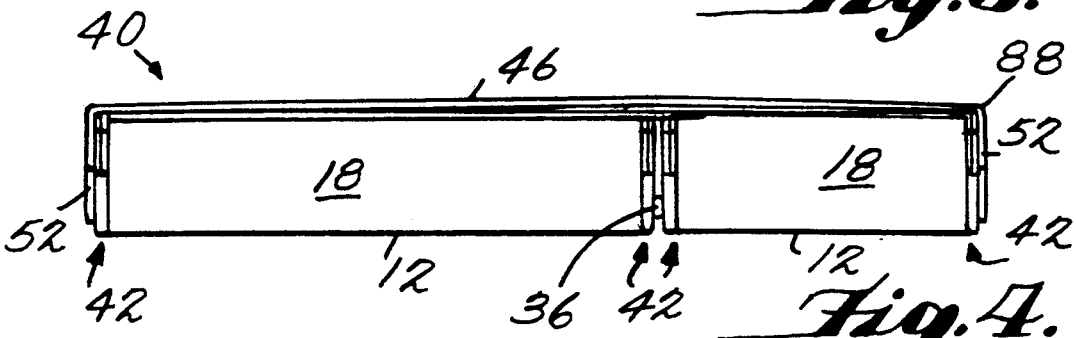
FIG. 3 is a side plan view of food package embodying the principles of the present invention.

To add to the rigidity of the carton tray 40, it is preferred, as shown in FIG. 3, that an adhesive 36 also be placed between the foldably attached adjacent side wall panels forming partition 76 to hold the partition walls in adhesive securement. In the most preferred embodiment, the adhesive 36 is placed only between the side wall end portion 32 areas of the side wall panels 20 comprising partition 76. This maintains a space between the side walls 20 comprising partition 76 to maintain heat insulation between compartments in the event that one compartment contains warm food contents, while an adjacent compartment contains cool food contents. In the event that it becomes desireable to keep the contents in one of the compartments cool while another is heated, it is possible to provide the particular compartment, or the lid section covering the particular compartment with a shielding material. Where all food portions are to be heated the same, the side wall panels 20 may be adhesively held in abutting relation throughout.

Figure 4:
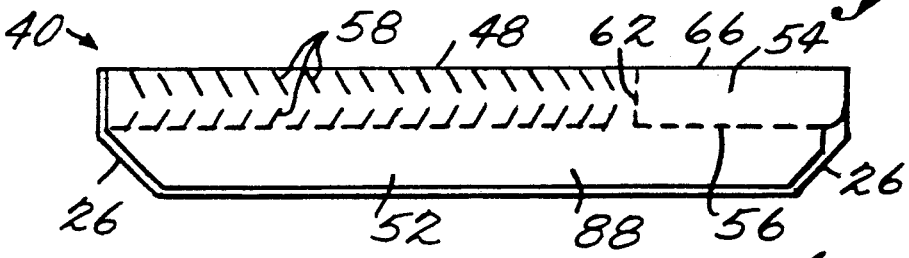
FIG. 4 is a front plan view of the package shown in FIG. 3.

It can be seen in FIGS. 2 and 4 that each sealed integral corner construction 42 of the carton tray 40 thus erected is defined (1) exteriorly by the associated gusset wall panel 22 adhesively adhered in abutting relation to the associated side wall end portion 32 with the associated end fold line 26 extending generally in the plane of the side wall panel 20 from the associated corner 16 and (2) interiorly by the associated end fold line 24 extending from the associated corner 16 along the surface of the associated side wall panel 20. It will be understood that the end fold lines need not extend exactly from the corner 16. Indeed, as previously stated, it is desirable that the end fold lines 24 be offset to an extent generally equal to the thickness of the blank material and the end fold lines 26 start in closely spaced relation from the corner 16. It will be noted that the carton tray 40 by itself functions well as an open top container for retaining in the aforesaid space consumable contents 80 of the type which may contain liquid so that the contents can be (1) heated in an oven while retained therein and (2) thereafter consumed while retained therein. It is further noted that the corner constructions 42 not only provide for an effective integral seal of the space at the corners but the outwardly extending condition of the corner constructions 42 at exterior corners 72 provide handles which enable a user to simply and conveniently carry the carton tray 40 to and from the oven. The oven may either be a conventional oven or a microwave oven, with the utilization in a microwave oven being the most popular and preferred. In this regard, it is desirable to carry the carton tray 40 by simply engaging the outwardly extending corner constructions 42 at any two opposite corners. It can thus be appreciated that to provide the tray with handles, the carton tray may be constructed to have only two of its exterior corners 72 with the corner construction 42, as long as all of the rest of the corners, whether exterior or other, are leak tight. However, in the most preferred embodiment, all corners are constructed with the corner construction 42 because of the ease and cost savings of manufacture.

Figure 5:
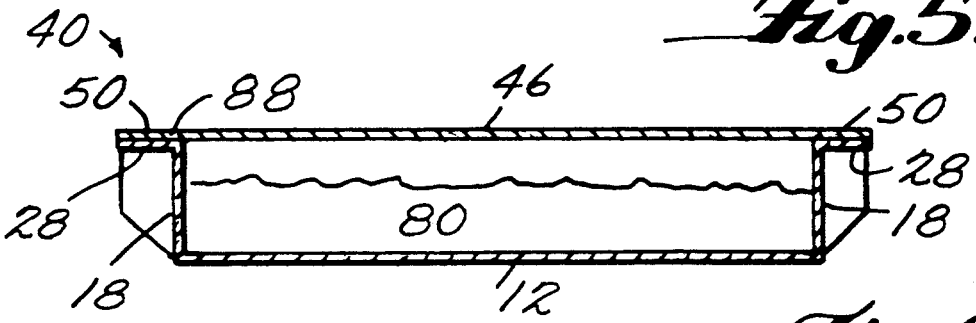
FIG. 5 is a sectional view taken along the line 5—5 of FIG. 2 but showing the package of FIG. 3 which includes the food portions and lid in addition to the carton tray of FIG. 2.
Figure 6:
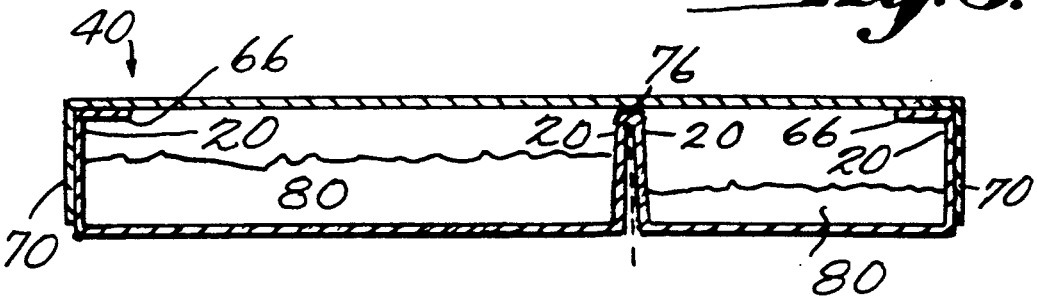
FIG. 6 is a sectional view taken along the line 6—6 of FIG. 2 but showing the package of FIG. 3 which includes the food portions and lid in addition to the carton tray of FIG. 2.

In the broadest aspects of the present invention, the flange panels 28 and 66 may be folded along their respective outer edges 8 either outwardly or inwardly to engage a carton lid. The construction of the fold lines are chosen to be suitable to the direction of the fold. As shown in FIGS. 2 and 5 it is preferable that the flange panels 28 be folded outwardly so as to be enabled to be in cooperating relation with marginal edge portions 50 of the preferred carton lid part 88. On the other hand, as shown in FIGS. 2 and 6, it is preferable that flange panels 66 be folded inwardly to allow lid flaps 52 of carton lid part 88 to be folded downwardly to engage the exterior of the second opposing carton side walls 70 to form a carton package containing contents 80 within the space above the bottom wall panel 12 defined by the side wall panels.

Figure 7:
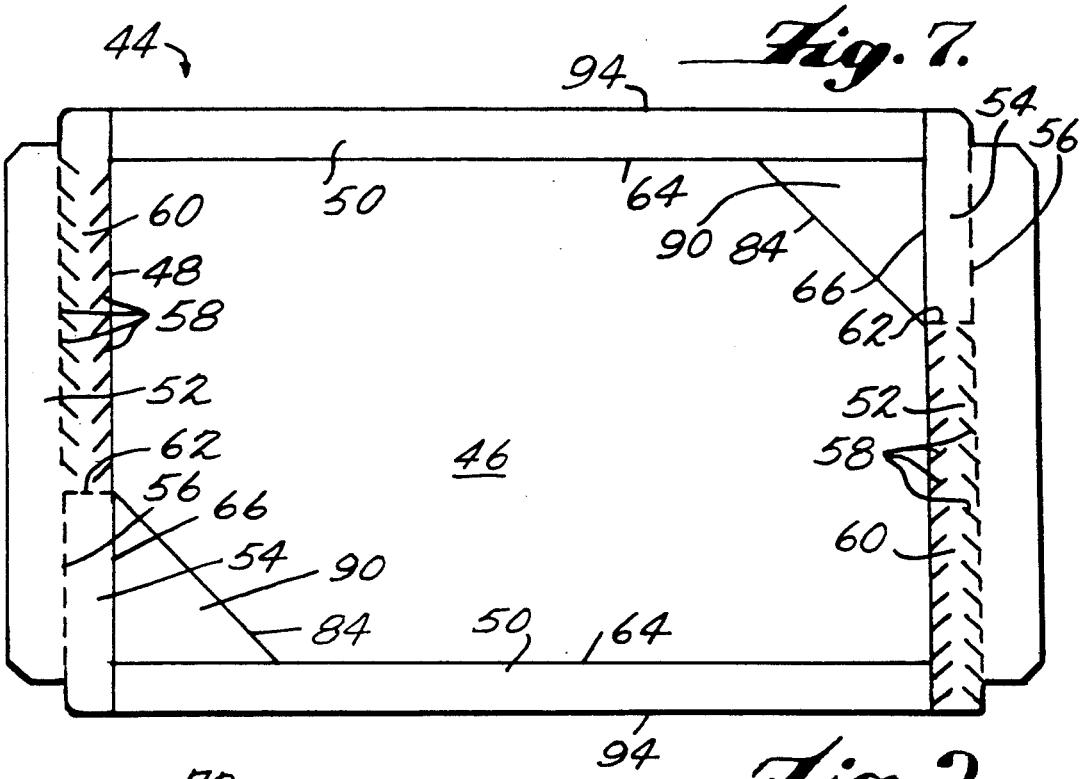
FIG. 7 is a plan view of the carton lid blank which is erectable and cooperable with the erected carton tray of FIG. 2 to form the package of FIGS. 3-6.

The nature of the carton lid, such as carton lid blank 44 shown generally in FIG. 7, is dependent to a considerable extent on the contents to be enclosed within the carton package. In some instances where the contents are dry and capable of being reconstituted when water is added thereto, a minimum sealing capability of the carton package is required. On the other hand, where the contents contain liquid, it is much more desirable that the lid be firmly sealed with respect to the carton tray.

Carton lid blank 44 is erectable into a separate carton lid part 88, shown in side view in FIGS. 3, 4, and 5, to cooperate with the carton tray 40. The carton lid blank 44 includes a main lid wall panel 46 having a rectangular configuration. Formed integrally with the lid wall panel 46 along inner 50% cut lines 64 at opposing sides of the lid wall panel 46 is a pair of marginal edge portions 50. Each marginal edge portion 50 is defined by an inner 50% cut line 64 and an outer 50% cut line 94 which run parallel. The marginal edge portions 50 are configured to remain unfolded so as to engage the outwardly folded flange panels 28 of the carton tray 40. Formed integrally with the lid wall panel 46 along a pair of opposite fold lines 48 is a pair of lid flaps 52. The lid flaps 52 are foldable along fold lines 48 to engage the exterior of the side wall panels 20 comprising the second opposing carton side walls 70 of the carton tray 40. Lid flaps 52 include portions coextensive with the end portions 32 of said side wall panels 20 comprising the second opposing carton side walls 70.

Preferably, the carton lid part 88 is constructed so as to be simply and conveniently manually disconnectable from the carton tray 40 to an extent sufficient to provide (1) a vent for the consumable contents when heated in an oven and (2) access to the heated contents when removed from the oven. Preferably, the two functions are desirably performed in sequence. However, it will be understood that an extent of disconnection sufficient to provide access to the heated contents will automatically provide sufficient disconnection for a vent. Consequently, in the broadest aspects of the present invention, the means in the carton lid part 88 for facilitating manual disconnection of a portion of the carton lid part 88 from the carton tray 40 can be a single means. It is preferred, however, to provide two separate means which are capable of operation in sequence to provide first a vent and then access. Nevertheless, in its broadest aspects, the invention contemplates elimination of facilitating means in favor of venting and access by means of a tool, such as a sharp knife or the like.

FIGS. 7 and 4 illustrate the preferred arrangement of the carton lid blank 44 and as erected as carton lid part 88, respectively. As shown, there is provided a tab 54 at one end of the lid flaps 52. The tab 54 is formed by a tab cut 56 extending inwardly from the adjacent end of the lid tab 54 and then by a perpendicular cut 62 transversely to the associated fold line 48. Formed in the two lid flaps 52 as an extension of the tab is a series of parallel cuts 58 defining a pull tab or zip strip 60 within a portion of the associated lid flap 52 adjacent the associated fold line 48. The innermost series of cuts 58 form the majority of the associated fold line 48, the remainder of which is a bar score 66.

A carton food package is formed by engaging the marginal edge portions 50 of the carton lid blank 44 into abutting relationship with the outwardly turned flange panels 28 and simply folding down the lid flaps 50 into abutting relation with the exterior of the second opposing carton side walls 70. The abutting relationships are retained by suitable adhesive or heating the films on the abutting surfaces. When marginal edge portions 50 are adhered to outwardly folded flanges 28, parallel 50% cut lines 64 and 94 facilitate delamination between the parallel cut lines in accordance with known practice.

When used, it can be seen that grasping the vent tab 54, and pulling up on the same, causes tab cut 56 and perpendicular cut 62 to release the tab 54 from the plane of the lid flap 52. As the lifting tab 54 is moved upwardly, the side, defined by the end portion 66 of the associated lid flap fold line 48, of the triangular corner portion 90 defined by the diagonal fold line 84 is separated from the lid flap 52 so that, by pulling up on the lifting tab, the remaining leg of the triangular corner defined by the parallel 50% cut lines 64 and 94 will effectively delaminated between the parallel cuts allowing the corner portion to be hinged upwardly along the fold line 84. This vents the associated contents in the associated compartment to the atmosphere to provide a vent for heating the contents of the package in an oven, as, for example, a microwave oven. After the contents of the package have been heated in the oven and the package removed from the oven to a table by carrying the same while manually gripping two opposed corner constructions 42, the user can then pull the zip strip 60 which serves to disengage the associated lid flap 52 from the lid wall panel 46. It then becomes a simple matter to continue to remove substantially the entire carton lid wall panel 46 by pulling up on the tab 54 and disconnecting it from the remainder of the package by delamination between the 50% cut lines 64 and 94.

While it is preferable to adhesively adhere the lid flaps 52 in surface-to-surface engagement with the second opposing carton side walls 70, in the broader aspects of the invention the securement could be accomplished by providing bottom flaps extending inwardly from the lower edges of the lid flaps 52 and adhesively adhering the bottom flaps underneath the bottom wall panels 12. An example of such an arrangement is shown in the '599 application. Moreover, the associated flange panels need not be folded inwardly but could either be eliminated or folded outwardly and then adhesively adhered to the lid flaps and folded downwardly therewith.

Likewise, while it is preferable that the flange panels 28 along first opposing carton side walls 68 are outwardly folded and adhesively adhered to the corresponding marginal edge portions 50 of lid 44, in the broader aspects of the invention, the securement could be made between the flange panels 28 and additional lid flaps replacing the marginal edge portions. The additional lid flaps and flange panels 28 may be provided with slits to accommodate protruding corner constructions as the additional lid flaps and flange panels are folded downwardly from the lid wall panel 46. The additional lid flaps and flange panels 28 can be adhesively adhered to either the side wall panels 28 with which the flange panels 28 are integral or by additional bottom flaps on the additional lid flaps adhesively secured to the bottom wall panels 12. Moreover, where such additional top flaps are utilized to effect the securement as aforesaid, the associated flange panels 28 may either extend inwardly or be eliminated altogether.

It is further understood that there is no particular critical location of the cuts insofar as the broad aspects of the present invention is concerned. That is, any conventional means for facilitating disengagement of the lid from the carton tray, including any arrangement of perforated cuts in the lid, may be used. Additionally, the lifting tab 54 and corner portion 90 associated with each compartment may be on any one of the corners of the associated compartment with the zip strip extending alongside the lifting tab.

Although in the preferred embodiment the corner constructions at the exterior corners extend in a direction perpendicular to the direction in which the compartments are aligned, in the broader aspects of the present invention, any one or more of the exterior corners may extend in the same direction in which the compartments are aligned.

It will be seen that the objects of this invention have been fully and effectively accomplished. It will be realized that the foregoing preferred specific embodiment has been shown and described for the purpose of this invention and is subject to change without departure from such principles. This invention includes all modifications encompassed within the spirit and scope of the following claims.

What is claimed is:

1. A carton tray having a plurality of inner compartments suitable to retain consumable contents therein containing liquid so that the contents can be (1) heated in an oven while retained therein and (2) thereafter consumed while retained therein, said carton tray, for each compartment, includes:

a bottom wall panel having a periphery defined by interconnecting side fold lines interrelated so that each adjacent pair of side fold lines extends at an angle with respect to each other from a corner point defining a corner of said bottom wall panel, side wall panels with outer edges, said side wall panels being integral with said bottom wall panel along said side fold lines and interrelated so that there are a plurality of pairs of adjacent side wall panels, said side wall panels being folded along said side fold lines in a direction which is the same relative to said bottom wall panel to form compartment sides, gusset wall portions providing an integral interconnection between each pair of adjacent side wall panels, said gusset wall portions being folded and sealed to form leak tight sealed corners, said compartments being integrally interconnected and arranged in side-by-side relation to provide the carton tray with an exterior periphery having spaced exterior corners, the integral interconnection of said compartments being provided on side wall panels of adjacent compartments which are foldably attached to one another along their outer edges to form a partition between adjacent compartments, at least two of said exterior corners being of a sealed integral corner construction, said integral corner construction having the gusset wall portion associated with the pair of side wall panels thereof comprising a gusset wall panel integral with the associated pair of adjacent side wall panels along two end fold lines extending in angular relation with respect to one another from the corner point associated with the pair of adjacent fold lines with which said pair of adjacent side wall panels is integral, said sealed integral corner construction having said gusset wall panels being folded along the associated angularly related end fold lines in opposite directions with respect to the associated pair of adjacent side wall panels so as to bring said associated gusset wall panel into surface-to-surface abutting relation with an end portion of one of the associated pair of adjacent side wall panels defined by one of the associated two end fold lines, and an adhesive adhering each of said gusset wall panels associated with said at least two exterior corners in surface-to-surface abutting relation with the associated one side wall end portion so that said sealed integral corner construction is defined (1) exteriorly by the associated gusset wall panel adhesively adhered in abutting relation to the associated one side wall end portion with the associated one end fold line extending generally in a plane coincident with an interior surface of the associated one side wall panel from the associated corner point and (2) interiorly by another of the associated two end fold lines extending from the associated corner point generally along the interior surface of the associated one side wall panel.

2. A carton tray as defined in claim 1 wherein each of said exterior corners is of said sealed integral corner construction.

3. A carton tray as defined in claim 1 wherein each of said leak tight sealed corners is of said sealed integral corner construction.

4. A carton tray as defined in claim 3, wherein the foldably attached adjacent side wall panels of adjacent compartments have their side wall end portions in surface-to-surface abutting relation with each other.

5. A carton tray as defined in claim 4, wherein an adhesive adheres each of said side wall end portions in surface-to-surface abutting relation with the associated adjacent side wall end portions of each pair of adjacent compartments.

6. A carton tray as defined in claim 5 wherein said side wall panels along said exterior periphery further include flange panels foldably integral along the outer edges thereof.

7. A carton tray as defined in claim 6 wherein said side wall panels along said exterior periphery comprise first and second pairs of opposing carton side walls, said side wall end portions being provided at opposite ends of said second pair of opposing carton side walls so that said integral sealed corner constructions extend outwardly from opposite ends of said first pair of opposing carton side walls, said flange panels of said side wall panels being folded along said outer edges so as to extend in generally parallel relation with respect to said bottom wall panel.

8. A carton tray as defined in claim 7, wherein said flange panels of said side wall panels comprising said first pair of opposing carton side walls are folded outwardly and said flange panels of said side wall panels comprising said second pair of opposing carton side walls are folded inwardly.

9. A carton tray as defined in claim 8, wherein said outwardly folded flange panels have extending end portions overlapping adjacent extending end portions of adjacent outwardly folded flange panels.

10. A carton tray as defined in claim 9 wherein said carton tray forms a carton tray part of a carton package which includes a carton lid part having a lid wall panel with a pair of opposing marginal edge portions and a pair of opposing lid flaps hinged to said lid wall panel along lid flap fold lines, said opposing marginal edge portions being adhesively adhered in surface-to-surface engagement with said outwardly folded flange panels, said opposing lid flaps being folded into abutting relation and adhered to the exterior of said second pair of opposing carton side walls, said lid wall panel being disposed in generally parallel relation with said bottom wall panel so as to enclose consumable contents therebetween within said side wall panels.

11. A carton package as defined in claim 10 wherein said carton lid part includes means for facilitating manual disconnection of said lid wall panel from said carton tray, said means for facilitating manual disconnection including cuts enabling the lid wall panel to be manually disconnectable from said carton tray to an extent sufficient to provide (1) vents for the consumable contents when heated in an oven and (2) access to the heated contents when removed from the oven.

12. A carton package as defined in claim 11 wherein said cuts include (1) parallel cuts in each lid flap extending partially therethrough forming first and second parallel cut lines, said first parallel cut line extending along the lid flap fold line, said second parallel cut line at a spaced position so as to define therebetween a strip section of each lid flap which can be separated to provide access to one of the compartments, and (2) tab defining cuts in each lid flap defining a lifting tab hinged to a corner portion of the lid wall panel along an end portion of the associated lid flap fold line suitable to be gripped and manually lifted to separate the lid wall panel from the carton tray.

13. A carton package as defined in claim 12 wherein each said tab defining cuts include:

a perpendicular cut, said perpendicular cut being substantially perpendicular to said first and second parallel cut lines, said perpendicular cut interconnecting said first and second parallel cut lines so as to define an end of said strip section, and a tab cut, said tab cut extending from the point at which said perpendicular cut interconnects with said second parallel cut line in a direction substantially away from said second parallel cut line so that said tab cut and said second parallel cut line form a substantially straight line.

14. A carton package as defined in claim 13 wherein each of said corner portions of the lid wall panel are defined by a diagonal fold line extending from the point at which said first parallel cut line interconnects with said perpendicular cut through an adjacent marginal edge portion.

15. A carton package as defined in claim 14 wherein said lifting tabs facilitate an initial manual lifting of the corner portions of the lid wall panel so that said corner portions of the lid wall panels may be folded back along the diagonal fold lines to vent the associated compartment during heating in an oven.

16. A carton package as defined in claim 15 wherein said manually disconnecting facilitating means further includes 50% cut lines in the interior side of said lid wall panel delineating the marginal edge portions thereof for causing said marginal edge portions to delaminate in response to a manual lifting of said lid wall panel.

17. A carton package as defined in claim 16 wherein said second pair of opposed side wall panels have exterior embossments therein to facilitate the adhered abutting relationship of said pair of lid flaps.

18. A carton tray as defined in claim 7 wherein said carton tray forms a carton tray part of a carton package which includes a carton lid part having a lid wall panel disposed in generally parallel relation with said bottom wall panel so as to enclose consumable contents therebetween within said side wall panels, said lid wall panel having marginal edge portions extending outwardly from said first pair of opposing carton side walls in generally outwardly coextensive relation with said integral sealed corner constructions, said carton package being constructed so that (1) the corner constructions and lid wall panel marginal edge portions are (A) stabilized for handling and shipping, (2) the carton package can be (A) oriented in a display position wherein said second pair of opposing carton side walls extend in generally vertically spaced horizontal relation and (B) supported in such a display position in a guided stable fashion on a similar carton package in a similar display position, and (3) the portions of the carton package extending outwardly from the first pair of opposed side wall panels provide stable handles for enabling the carton package to be conveniently manually carried to and from a heating oven.

19. A one-part carton blank comprising a plurality of compartment blank sections erectable to form a carton tray having a plurality of inner compartments suitable to retain consumable contents therein containing liquid so that the contents can be (1) heated in an oven while retained therein and (2) thereafter consumed while retained therein, said carton blank is cut and scored so that each compartment blank section includes:

a bottom wall panel having a periphery defined by interconnecting side fold lines interrelated so that each adjacent pair of side fold lines extends at an angle with respect to each other from a corner point defining a corner of said bottom wall panel, side wall panels with outer edges, said side wall panels being integral with said bottom wall panel along said side fold lines and interrelated so that there are a plurality of pairs of adjacent side wall panels, said side wall panels being foldable along said side fold lines in a direction which is the same relative to said bottom wall panel to form compartment sides, gusset wall portions providing an integral interconnection between each pair of adjacent side wall panels, said gusset wall portions being foldable and sealable to form leak tight sealed corners, said compartment blank sections being integrally interconnected and arranged in side-by-side relation to provide the carton blank when erected with an exterior periphery having spaced exterior corners, the integral interconnection of said compartment blank sections being provided on side wall panels of adjacent compartments which are foldably attached to one another along their outer edges to form a partition between adjacent compartments when folded, at least two of said exterior corners each having the gusset wall portion associated with the pair of side wall panels thereof comprising a gusset wall panel integral with the associated pair of adjacent side wall panels along two end fold lines extending in angular relation with respect to one another from the corner point associated with the pair of adjacent fold lines with which said pair of adjacent side wall panels is integral, each of said at least two exterior corners having said gusset wall panels being foldable along the associated angularly related end fold lines in opposite directions with respect to the associated pair of adjacent side wall panels so as to bring said associated gusset wall panel into surface-to-surface abutting relation with an end portion of one of the associated pair of adjacent side wall panels defined by one of the associated two end fold lines, and each of said gusset wall panels associated with said at least two exterior corners being capable of being adhesively adhered in surface-to-surface abutting relation with the associated one side wall end portion to thereby form a sealed integral corner construction between the associated pair of adjacent side wall panels which is defined (1) exteriorly by the associated gusset wall panel adhesively adhered in abutting relation to the associated one side wall end portion with the associated one end fold line extending generally in a plane coincident with an interior surface of the associated one side wall panel from the associated corner point and (2) interiorly by another of the associated two end fold lines extending from the associated corner point generally along the interior surface of the associated one side wall panel.

20. A food package comprising a plurality of separate portions of food inside a plural compartment carton tray, said carton tray being sealed by a lid and, for each compartment, including:

a bottom wall panel having a periphery defined by interconnecting side fold lines interrelated so that each adjacent pair of side fold lines extends at an angle with respect to each other from a corner point defining a corner of said bottom wall panel, side wall panels with outer edges, said side wall panels being integral with said bottom wall panel along said side fold lines and interrelated so that there are a plurality of pairs of adjacent side wall panels, said side wall panels being folded along said side fold lines in a direction which is the same relative to said bottom wall panel to form compartment sides, gusset wall portions providing an integral interconnection between each pair of adjacent side wall panels, said gusset wall portions being folded and sealed to form leak tight sealed corners, said compartments being integrally interconnected and arranged in side-by-side relation to provide the carton tray with an exterior periphery having spaced exterior corners, the integral interconnection of said compartments being provided on side wall panels of adjacent compartments which are foldably attached to one another along their outer edges to form a partition between adjacent compartments, at least two of said exterior corners each having the gusset wall portion associated with the pair of side wall panels thereof comprising a gusset wall panel integral with the associated pair of adjacent side wall panels along two end fold lines extending in angular relation with respect to one another from the corner point associated with the pair of adjacent fold lines with which said pair of adjacent side wall panels is integral, each of said at least two exterior corners having said gusset wall panels being folded along the associated angularly related end fold lines in opposite directions with respect to the associated pair of adjacent side wall panels so as to bring said associated gusset wall panel into surface-to-surface abutting relation with an end portion of one of the associated pair of adjacent side wall panels defined by one of the associated two end fold lines, and an adhesive adhering each of said gusset wall panels associated with said at least two exterior corners in surface-to-surface abutting relation with the associated one side wall end portion to thereby form a sealed integral corner construction between the associated pair of adjacent side wall panels which is defined (1) exteriorly by the associated gusset wall panel adhesively adhered in abutting relation to the associated one side wall end portion with the associated one end fold line extending generally in a plane coincident with an interior surface of the associated one side wall panel from the associated corner point and (2) interiorly by another of the associated two end fold lines extending from the associated corner point generally along the interior surface of the associated one side wall panel.

* * * * *